United States Patent [19]

Muscatell

[11] 4,265,381

[45] May 5, 1981

[54] BEVERAGE AND LIQUIFIED FOOD BELT

[76] Inventor: Steven C. Muscatell, 288 Douglas Ave., Boulder Creek, Calif. 95006

[21] Appl. No.: 15,464

[22] Filed: Feb. 26, 1979

Related U.S. Application Data

[63] Continuation-in-part of Ser. No. 937,105, Aug. 25, 1978.

[51] Int. Cl.[3] ..... A45C 1/04

[52] U.S. Cl. ..... 224/148; 2/312

[58] Field of Search ..... 224/148, 191, 224, 251, 224/249; 222/212, 107, 251, 175; 2/312; 9/340

[56] References Cited

U.S. PATENT DOCUMENTS

| | | | |
|---|---|---|---|
| 765,472 | 7/1904 | Gasaway et al. | 224/148 |
| 1,304,114 | 5/1919 | Staples | 224/148 |
| 1,650,764 | 11/1927 | Marin | 224/148 |
| 2,809,771 | 10/1957 | Wand | 222/107 |
| 3,037,670 | 6/1962 | Erlichman | 222/107 |
| 3,814,288 | 6/1974 | Westrich | 224/148 |
| 4,139,130 | 2/1979 | Glusker et al. | 224/148 |
| 4,176,772 | 12/1979 | Danon | 224/148 |

*Primary Examiner*—Robert J. Spar
*Assistant Examiner*—Kenneth Noland
*Attorney, Agent, or Firm*—F. D. LaRiviere

[57] ABSTRACT

A belt for carrying beverages and liquified food.

3 Claims, 6 Drawing Figures

BEVERAGE AND LIQUIFIED FOOD BELT

CROSS REFERENCE TO RELATED APPLICATION

This is a continuation-in-part of application Ser. No. 937,105 filed on Aug. 25, 1978.

BACKGROUND AND SUMMARY OF THE INVENTION

During strenuous physical activity, such as jogging, hiking, bicycle and motorcycle trail riding, horseback riding and the like, most medical doctors recommend that the participant ingest liquid to prevent dehydration. Typically water or other liquid nourishment is carried or worn on the body in containers. Many participants rely on canteens, plastic bottles, boda bags and other similar containers to hold their supply of such liquid during the activity.

Such prior art liquid containers are simply inconvenient to carry. They are often bulky in shape and worn on a waist belt, shoulder strap or otherwise attached to the clothing or body of the participant. When so carried, the container and its attachment frequently interferes with the activity by its position on or near the waistline, under the arm or elsewhere on the body. Furthermore, the weight of the container and liquid it holds is unevenly distributed on the body of the participant. The uneven weight distribution may also interfere with the activity, and probably contributes unnecessarily to the discomfort and fatique of the user.

The beverage and liquified food belt of the present invention is a slim, lightweight, flexible, hollow tube having a removable cap at each end for filling, emptying and cleaning, and an adjustable fastener for circumferentially attaching one end to the other. The belt is preferably worn around the waist, but may be worn around the neck or over the shoulder as the participant desires. Since the liquid tends to flow throughout the length of the belt, the weight distribution thereof is substantially even over the length of the container.

DESCRIPTION OF THE PREFERRED EMBODIMENT

Figure 1:
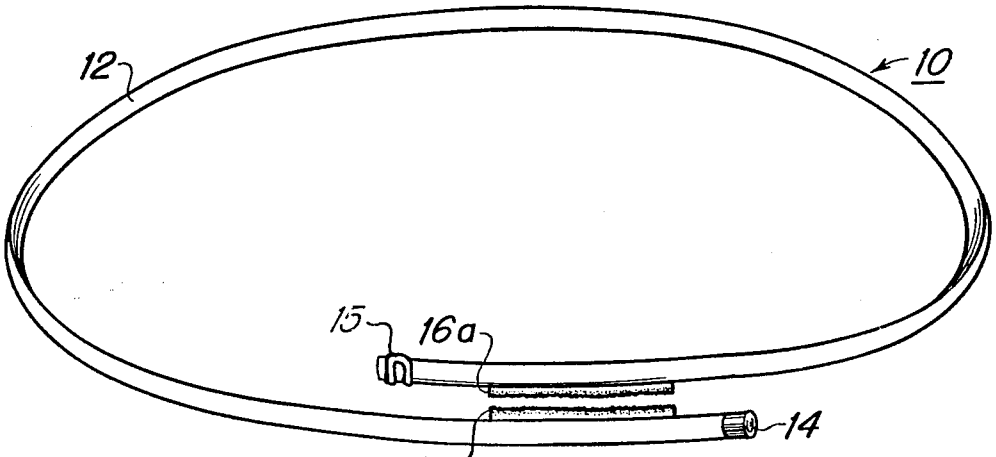
FIG. 1 is a perspective view of a beverage and liquified food belt constructed according to the preferred embodiment of the present invention.
Figure 2:
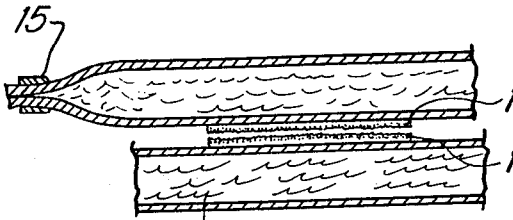
FIG. 2 is a cutaway view of a portion of the belt and fastener of the belt of FIG. 1.
Figure 3:
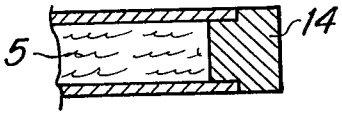
FIG. 3 is a cutaway view of a portion of the belt and cap of the belt of FIG. 1.

Referring to FIG. 1, beverage and liquified food belt 10, constructed according to the preferred embodiment of the present invention, comprises tube 12, closure 14 and 15, and fastener 16*a* and 16*b* for containing liquids. Tube 12 may be any non-toxic, flexible tubing, preferably transparent or translucent for observing the liquid therein, having resilient properties similar to an ordinary leather belt for accommodating the contours of the human body. Closure 14 may be as simple as a cork inserted into the end of tube 12, but is preferably a non-toxic plastic cap having male threads for removably engaging corresponding female threads in a mating ring attached to each end of tube 12. The closure may be attached to tube 12 by a suitable bonding technique, but preferably by selective heating of the tubing and closure to their respective melting points for fusing them together. Chemical bonding utilizing a non-toxic adhesive or solvent may also be used. Closure 15 may be as simple as a leaf spring clip similar to the common "bobby-pin" for convenient removal to clean or fill tube 12. User comfort is enhanced by arranging fasteners 16*a* and 16*b* such that the end of tube 12 flattened by clip 15 is next to his body when the belt is wrapped around his waist. Of course, clip 15 can be replaced with another closure, such as cap 14, if desired. Fastener 16*a* and 16*b* preferably comprises an interlocking material which may be affixed to the outer surface of tube 12 near each end. The commercially available fastening material known on the market as "Velcro" is particularly suited to this application, since its length at each end of tube 12 can be selected to allow the belt to be adjusted to waist size of the user over a range of sizes. Such fasteners may be affixed to tube 12 by any suitable means such as described above for attaching closure 14.

Belt 10 may be worn in any other manner that is comfortable to the user, for example, as a bandolier, i.e. under one arm and over the opposite shoulder. It also may be simply coiled as a rope and carried.

Figure 4A:
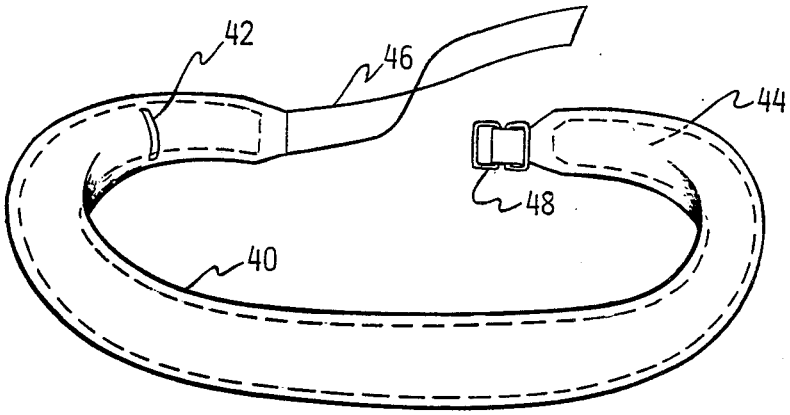
FIG. 4*a* is a back perspective view of a beverage and liquified food belt constructed according to another embodiment of the present invention.
Figure 4B:
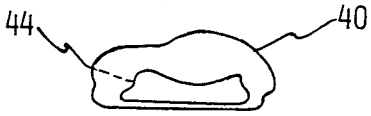
FIG. 4*b* is a front perspective view of a beverage and liquified food belt constructed according to the embodiment of FIG. 4*a*.

In another embodiment of the invention shown in FIGS. 4*a* and 4*b*, belt 10 now includes outer sleeve 40 for containing inner tube 44 (shown as dotted lines) and having buckle 48 for coupling to sleeve end 46. Tube 44 is inserted into sleeve 40 via slot 42 and includes filler cap 45 and outlet 47 which align with and protrude through holes 41 and 43 in sleeve 40. Inner tube 44 may be constructed of polyvinylchloride (PVC) or other non-toxic, flexible, liquid-impervious material. The material used for inner tube 44 should be capable of forming a seam through which liquid does not leak, such seam being formed by either applying heat or appropriate chemical bonding material.

Outer sleeve 40 may be constructed of polypropylene, nylon, denim or other flexible, canvas-like material similar to that used for constructing knapsacks and backpacks and suitable for outdoor use. The material used for outer sleeve 40 should be capable of being sewn and the trimmed edges of which may be prevented from fraying by applying heat or other glue-like sealant. Filler cap 45 and outlet 47 are similar to those kind of caps commonly used on "Tupperware" or other plastic-like food containers.

Figure 5:
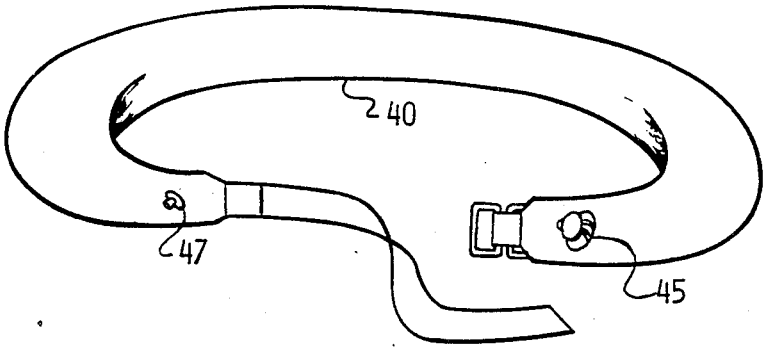
FIG. 5 is a cross-sectional view of the embodiment of FIG. 4*a*.

Since tube 44 is constructed of two sheets of the appropriate material, it lies flat when empty and has a generally elongated cross-sectional area as shown in FIG. 5. Thus, if the user does not permit air to re-enter the tube as its contents are drained or consumed, it collapses uniformly to conform itself and outer sleeve 40 to the contours of the user's body. Since buckle 48 and sleeve end 46 provide adjustment to various waist and body sizes, the user can adjust the belt for comfort and snug fit to eliminate bouncing or shifting on the body as the user participates in his activity.

I claim:

1. A belt for carrying beverages and liquified food comprising:

a flexible hollow tube for containing the beverage and liquified food, having a first closure means mounted at one end of the tube for liquid tight seal thereof and a second closure means mounted at the other end of the tube for liquid tight seal thereof;

said first and second closure means each having removable caps for filling and draining of beverage and liquified food from the tube; and an outer sleeve for containing the hollow tube, having fastening means continuously formed at one end thereof for circumferentially attaching one end of the sleeve to the other, and having an opening adjacent an end of said sleeve for withdrawal of the tube therefrom and insertion of the tube therein;

said opening in the sleeve being substantially aligned with the first closure means for filling or emptying the tube with beverage or liquified food when the tube is contained in the sleeve.

2. A belt as in claim 1 wherein the outer sleeve further includes another opening substantially aligned with the second closure means of the tube for extraction of beverage or liquified food therefrom when the tube is contained in the sleeve.

3. A belt as in claim 1 wherein the flexible hollow tube is substantially rigid and readily insertable into said outer sleeve through said opening when filled with beverage or liquified food.

* * * * *